US007719553B2

(12) United States Patent
Ito et al.

(10) Patent No.: US 7,719,553 B2
(45) Date of Patent: May 18, 2010

(54) EXPOSURE APPARATUS AND IMAGE FORMING APPARATUS

(75) Inventors: Masao Ito, Kanagawa (JP); Masahiko Fujii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 272 days.

(21) Appl. No.: 11/907,787

(22) Filed: Oct. 17, 2007

(65) Prior Publication Data

US 2008/0240785 A1 Oct. 2, 2008

(30) Foreign Application Priority Data

Mar. 30, 2007 (JP) ..... 2007-092542

(51) Int. Cl.
*B41J 2/45* (2006.01)

(52) U.S. Cl. ..... 347/130; 347/238

(58) Field of Classification Search ..... 347/130, 347/238

See application file for complete search history.

(56) References Cited

U.S. PATENT DOCUMENTS 5,543,830 A * 8/1996 Lea ..... 347/241
6,661,445 B2 * 12/2003 Mashimo et al. ..... 347/238
7,382,391 B2 * 6/2008 Kobayashi ..... 347/238
7,411,601 B2 * 8/2008 Kurose et al. ..... 347/238
7,525,563 B2 * 4/2009 Lee et al. ..... 347/241
2004/0021762 A1 * 2/2004 Seki et al. ..... 347/136

FOREIGN PATENT DOCUMENTS

| | | |
|---|---|---|
| JP | 8-156320 | 6/1996 |
| JP | 9-187991 | 7/1997 |
| JP | 2001-175064 | 6/2001 |
| JP | 2002-19176 | 1/2002 |
| JP | 3550076 B | 4/2004 |

* cited by examiner

*Primary Examiner*—Huan H Tran
(74) *Attorney, Agent, or Firm*—Morgan, Lewis & Bockius LLP

(57) ABSTRACT

An exposure apparatus comprises: a plurality of light sources; a first condensing unit, arranged to contact a light emitting surface of each of the light sources, that condenses the lights emitted from the plurality of light sources; and a second condensing unit that condenses the lights from each of the light sources, which are emitted from the first condensing unit, wherein the first condensing unit is configured so that a center of curvature of an output surface, to emit the light from the light source, of the first condensing unit is positioned near the side of the second condensing unit rather than an arrangement position of the light source.

10 Claims, 14 Drawing Sheets

EXPOSURE APPARATUS AND IMAGE FORMING APPARATUS

CROSS-REFERENCE TO RELATED APPLICATIONS

This application is based on and claims priority under 35 USC 119 from Japanese Patent Application No. 2007-092542 filed Mar. 30, 2007.

BACKGROUND (i) Technical Field

The present invention relates to an exposure apparatus and an image forming apparatus.

(ii) Related Art

As an image forming apparatus such as a printer and a copier using an electro photographic system, one provided with an exposure apparatus using a light emitting device array having light emitting devices such as an LED arranged in a line and a rod lens array having rod lenses having small diameters as a condenser device has been known.

SUMMARY

According to an aspect of the invention, there is provided an exposure apparatus comprising: a plurality of light sources; a first condensing unit, arranged to contact a light emitting surface of each of the light sources, that condenses the lights emitted from said plurality of light sources; and a second condensing unit that condenses the lights from each of the light sources, which are emitted from the first condensing unit, wherein the first condensing unit is configured so that a center of curvature of an output surface, to emit the light from the light source, of the first condensing unit is positioned near the side of the second condensing unit rather than an arrangement position of the light source.

BRIEF DESCRIPTION OF THE DRAWINGS

Exemplary embodiments of the present invention will be described in detail based on the following figure, wherein.

DETAILED DESCRIPTION

Hereinafter, with reference to the attached drawings, the exemplary embodiment of the present invention will be described in detail.

Figure 1:
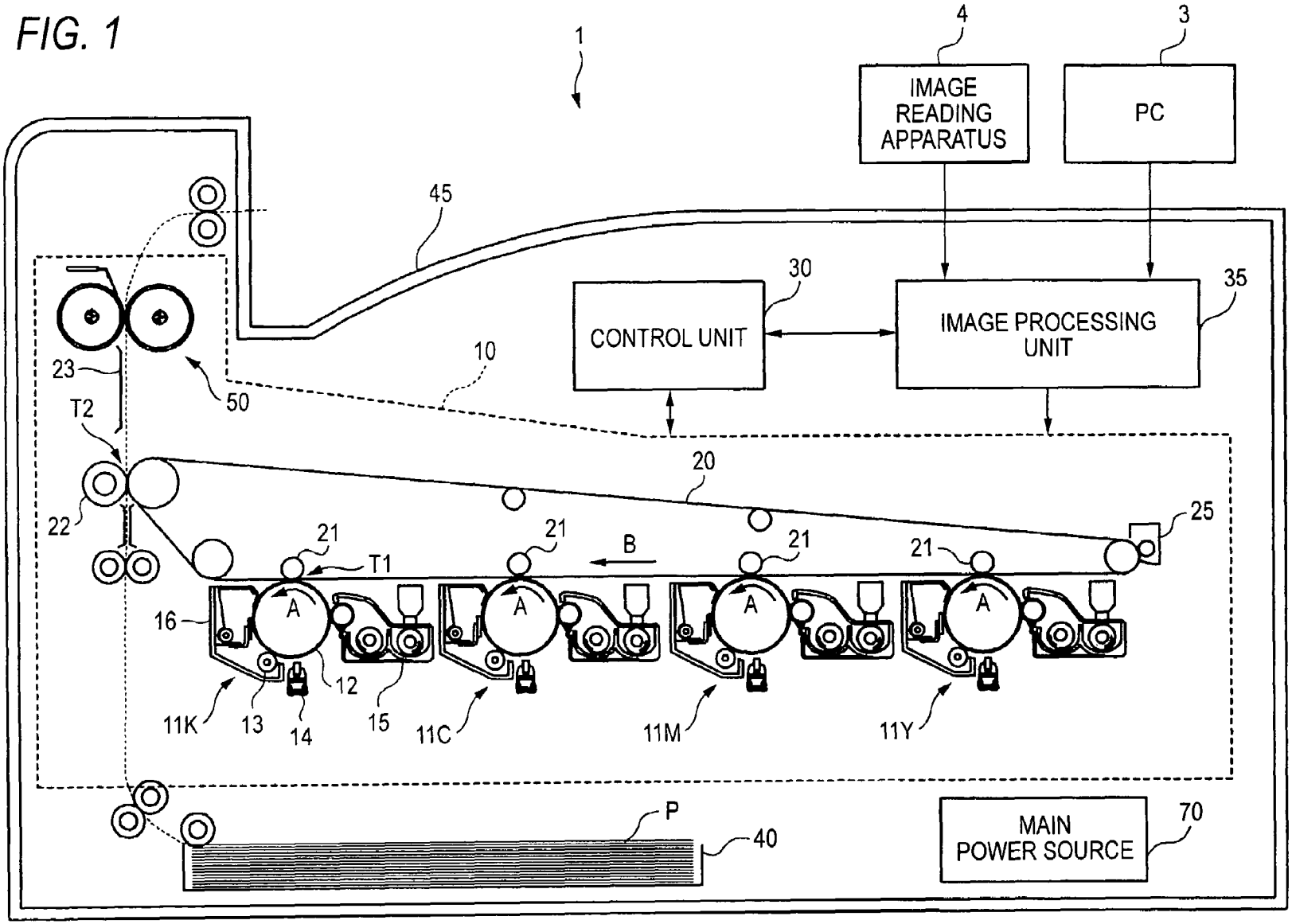
FIG. 1 is a view showing an example of the entire configuration of an image forming apparatus 1 to which the present exemplary embodiment is applied.

FIG. 1 is a view showing an example of the entire configuration of an image forming apparatus 1 to which the present exemplary embodiment is applied. The image forming apparatus 1 shown in FIG. 1 is a so-called tandem type of a digital color printer, and the image forming apparatus 1 is provided with an image forming process unit 10, a control unit 30 for controlling the entire operation of the image forming apparatus 1, an image processing unit 35 for applying predetermined image processing to the image data received from an outside device, for example, a personal computer (PC) 3 and an image reading apparatus 4 or the like, and a main power source 70 for supplying a power to respective units.

The image forming process unit 10 is provided with four image forming units 11Y, 11M, 11C, and 11K (hereinafter, they are merely named as "an image forming unit 11" in general). Each image forming unit 11 is provided with a photosensitive drum 12 as an image retaining body for retaining a toner image by forming an electrostatic image; a charging apparatus 13 for evenly charging the surface of the photosensitive drum 12 by a predetermined potential, an LED print head (LPH) 14 as an example of an exposure apparatus (an exposing unit) for exposing the photosensitive drum 12 that is charged by the charging apparatus 13 on the basis of the image data, a development unit 15 for developing an electrostatic latent image that is formed on the photosensitive drum 12, and a cleaner 16 for cleaning the surface of the photosensitive drum 12 after transcription.

In addition, each image forming unit 11 is configured substantially in the same way except a toner stored in the development unit 15. Then, image forming units 11Y, 11M, 11C, and 11K may form toner images of yellow (Y), magenta (M), cyan (C), and black (K), respectively.

Further, the image forming process unit 10 is provided with a middle transcription belt 20 on which respective toner images formed by the photosensitive drum 12 of each image forming unit 11 are multiply transcribed, a primary transfer roll 21 for transcribing (primarily transcribing) each color toner image of each image forming unit 11 on the middle transcription belt 20 in series, a secondary transfer roll 22 for collectively transcribing (secondarily transcribing) a toner image transcribed on the middle transcription belt 20 on a paper P that is a recording material (a recording paper), and a fixing apparatus 50 for fixing the secondarily-transcribed toner image on the paper P.

Here, each image forming unit 11 is formed as a module (hereinafter, referred to as "a photosensitive module MOD") that the photosensitive drum 12, the charging apparatus 13, and the cleaner 16 are integrated. Then, the photosensitive module MOD is detachably configured for the image forming apparatus 1, and the photosensitive module MOD is exchanged in accordance with a duration of life or the like. Further, the photosensitive module MOD can adopt the configuration of only the photosensitive drum 12 and the configuration that the development unit 15 is integrated in addition to the above-described constituent elements. In other words, if the configuration includes the photosensitive drum 12 having a shorter duration of time as compared to other constituent elements, the photosensitive module MOD can be configured also by a combination with any constituent element. However, the configuration of exchanging an LPH 14 having a relatively long duration of life with the photosensitive module MOD at the same time is uneconomical, so that according to the image forming apparatus 1 of the present exemplary embodiment, the LPH 14 and the photosensitive module MOD are configured separately.

In the image forming apparatus 1 according to the present exemplary embodiment, the image forming process unit 10 may carry out the image forming operation on the basis of various control signals supplied from the control unit 30. In other words, under the control by the control unit 30, the image data inputted from the PC 3 and an image reading apparatus 4 is applied with predetermined image processing by an image processing unit 35 and this image data is supplied to each image forming unit 11 via an interface (not illustrated). Then, for example, in the image forming unit 11K of black (K), the photosensitive drum 12 is evenly charged at a predetermined potential by the charging apparatus 13 while rotating in an arrow A direction to be exposed by the LPH 14 emitting a light on the basis of the image data transmitted from the image processing unit 35. Thereby, on the photosensitive drum 12, an electrostatic latent image regarding a black (K) color image is formed. Then, the electrostatic latent image formed on the photosensitive drum 12 is developed by the development unit 15 and a toner image of black (K) is formed on the photosensitive drum 12. In the same way, also in the image forming units 11Y, 11M, and 11C, respective toner images of yellow (Y), magenta (M), and cyan (C) are formed, respectively.

Respective color toner images formed by each image forming unit 11 are electrostatically sucked in series on the middle transcription belt 20 moving in the arrow B direction in circle in a primary transcribing portion T1 on which the primary transfer roll 21 is arranged. Thereby, on the middle transcription belt 20, a synthetic toner image on which respective color toners are superimposed is formed. The synthetic toner image on the middle transcription belt 20 is conveyed to a secondary transcribing portion T2 on which the secondary transfer roll 22 is arranged in accordance with movement of the middle transcription belt 20. In addition, in accordance with timing that the toner image is conveyed to the secondary transcribing portion T2, the paper P is conveyed from a paper retaining portion 40 to the secondary transcribing portion T2. Then, due to a transcription electric field formed by the secondary transfer roll 22, a synthetic toner image is collectively and electrostatically transcribed on the paper P in the secondary transcribing portion T2.

The paper P on which the synthetic toner image is electrostatically transcribed is separated from the middle transcription belt 20, is introduced to a conveying guide 23, and is conveyed to the fixing apparatus 50. In the fixing apparatus 50, the synthetic toner image is fixed receiving the fixing processing due to a heat and a pressure. Then, the fixed paper P is conveyed to a discharge accumulating unit 45 that is disposed on a discharge portion of the image forming apparatus 1.

On the other hand, the toner being attached to the middle transcription belt 20 after the secondary transcription (the transcription remaining toner) is removed from the surface of the middle transcription belt 20 by a belt cleaner 25 after the secondary transcription is competed and then, this is provided for a next image forming cycle.

In the image forming apparatus 1, such an image forming cycle is carried out repeating this cycle number of times of print sheet.

Figure 2:
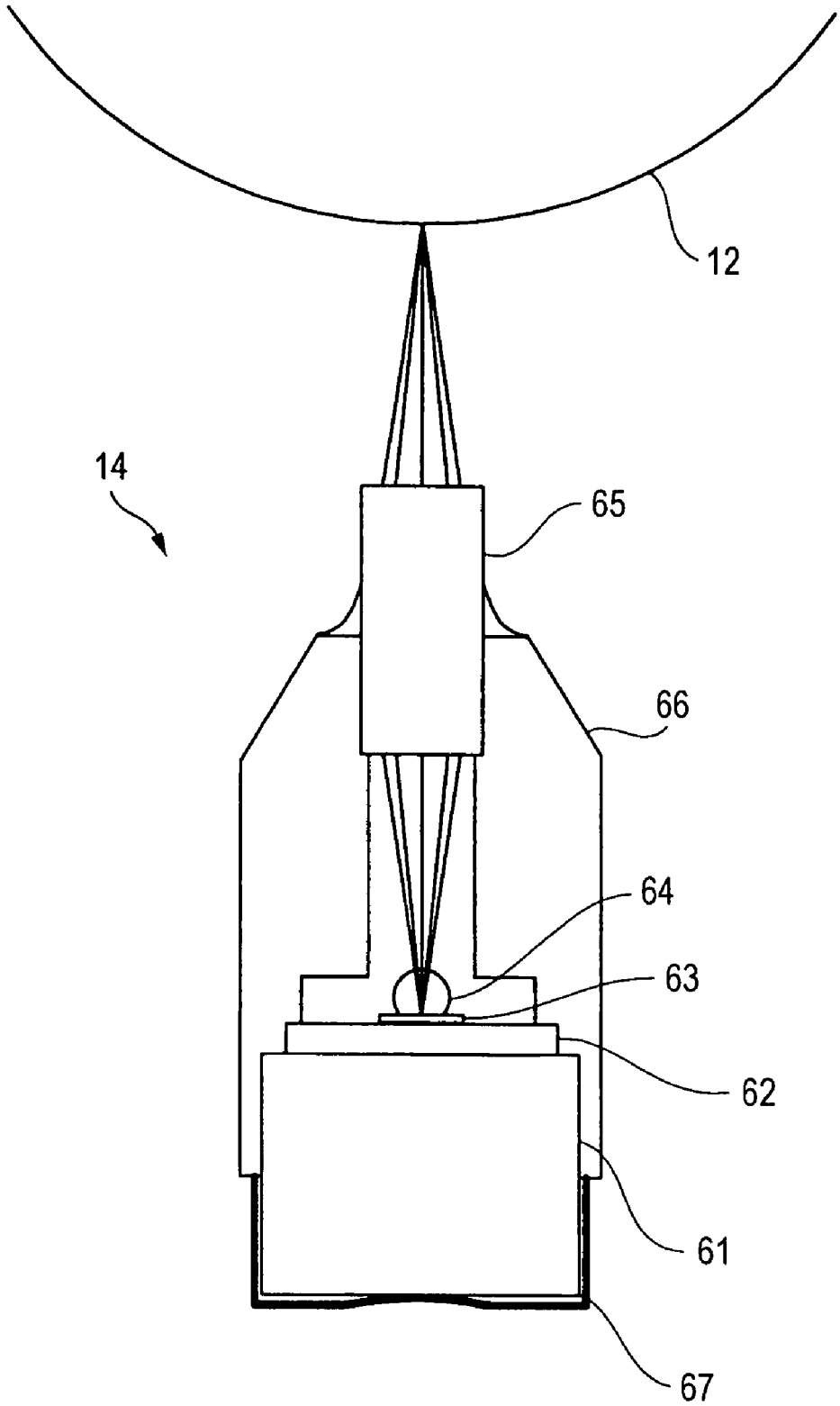
FIG. 2 is a cross sectional block diagram showing the configuration of an LED print head (LPH)

Next, FIG. 2 is a cross sectional block diagram showing the configuration of an LED print head (LPH) 14. In FIG. 2, the LPH 14 is provided with a housing 61 as a support body, a self-scanning type LED array (SLED) 63, a LED circuit board 62 mounting the SLED 63 and a signal generating circuit 100 (refer to a rear stage of FIG. 3) for driving the SLED 63 or the like thereon, a condenser lens 64 as an example of a first condensing unit for collecting the light emitted from the SLED 63, a rod lens array 65 as an example of a second condensing unit for providing an image of the light emitted from the SLED 63 via the condenser lens 64 on a surface of a photosensitive drum 12, a holder 66 for shielding the SLED 63 and the condenser lens 64 from the outside while supporting the rod lens array 65, and a platy spring 67 for pressurizing the housing 61 in a direction of the rod lens array 65.

The housing 61 is made of a metal block such as aluminum and SUS or a steel plate and it supports the LED circuit board 62. In addition, the holder 66 supports the housing 61 and the rod lens array 65, and the holder 66 determines, the SLED 63, the condenser lens 64 and the rod lens array 65 so as to maintain a predetermine optical positional relation each other. Further, the holder 66 is configured so as to seal the SLED 63 and the condenser lens 64. Thereby, the holder 66 may prevent the SLED 63 and the condenser lens 64 from being attached with dust from the outside. On the other hand, the platy spring 67 pressurizes the LED circuit board 62 in a direction of the rod lens array 65 via the housing 61 so as to maintain the optical positional relation among the SLED 63, the condenser lens 64, and the rod lens array 65.

The LPH 14 that is configured in this way is configured so as to be able to move in an optical axial direction of the rod lens array 65 by an adjustment screw (not illustrated) and the LPH is adjusted so that an image producing position (a focal surface) of the rod lens array 65 is located on the surface of the photosensitive drum 12.

Figure 3:
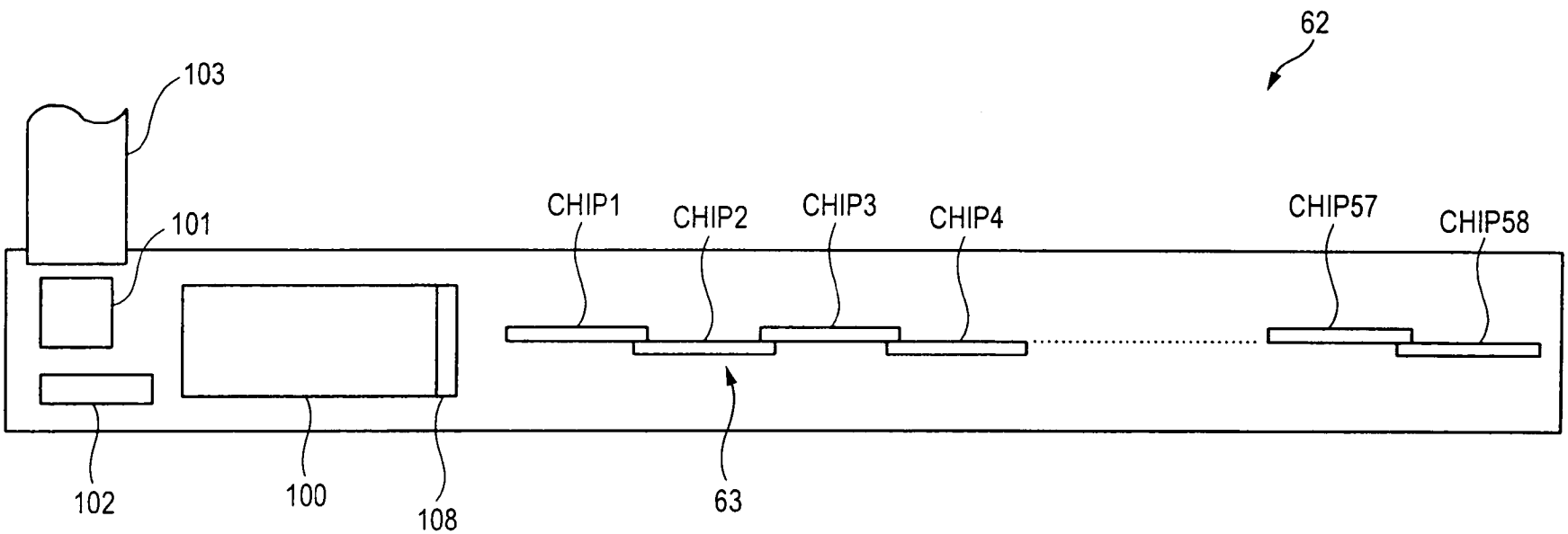
FIG. 3 is a plain view of an LED circuit board.

As shown in FIG. 3 (a plain view of the LED circuit board 62), the SLED 63 made of, for example, 58 pieces of SLED chips (CHIP 1 to CHIP 58) is arranged on the LED circuit board 62 in a line with a high degree of accuracy so as to be aligned in parallel with an axial direction of the photosensitive drum 12. In this case, respective SLED chips are alternately arranged in a hound's tooth check so that respective LED arrays so that respective LED arrays are continuously arranged at a connection portion of the SLED chips on an edge boundary of array (the LED array) of light emitting devices that is arranged on respective SLED chips (CHIP 1 to CHIP 58).

In addition, the LED circuit board 62 is provided with the signal generating circuit 100 for generating a signal (a drive signal) to drive the SLED 63 and a level shift circuit 108, a three-terminal regulator 10 for outputting a predetermined voltage, an EEPROM 102 for storing light amount correction data or the like of the SLED 63, and a harness 103 for sending and receiving a signal between the control unit 30 and the image processing unit 35 and being supplied with a power from the main power source 70.

Figure 4:
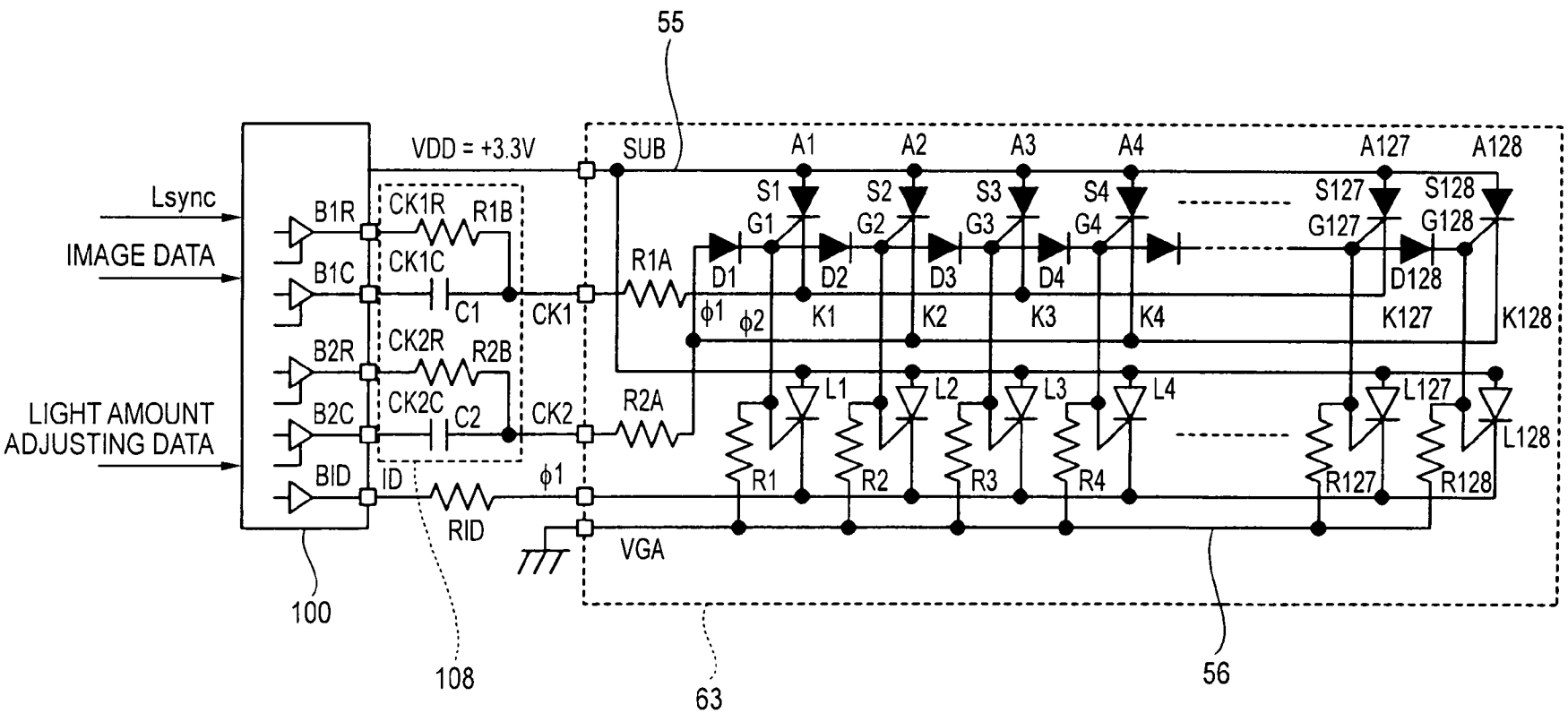
FIG. 4 is a view for explaining a SLED.

Here, FIG. 4 is a view for explaining the SLED 63. In the SLED 63 according to the present exemplary embodiment, various drive signals are supplied from the signal generating circuit 100 and the level shift circuit 108. In other words, the signal generating circuit 100 may generate transfer signals CK1R, CK1C and transfer signals CK2R, CK2C for setting each LED arranged on each SLED chip forming the SLED 63 to be lighted along the array of the LED and a lighting signal ϕI for lighting each LED on the basis of the image data from the image processing unit 35 in series. Then, outputting the transfer signals CK1R, CK1C and the transfer signals CK2R, CK2C to the level shift circuit 108, the signal generating circuit 100 may output the lighting signal ϕI to the SLED 63.

The level shift circuit 108 has the configuration such that a resistance R1B and a capacitor C1 and a resistance R2B and a capacitor C2 are arranged in parallel, respectively, and each one end is connected to an input terminal of each SLED chip forming the SLED 63 and each other end is connected to an output terminal of the signal generating circuit 100. Then, the level shift circuit 108 may generate the transfer signal CK1 and the transfer signal CK2 on the basis of the transfer signals CK1R, CK1C and the transfer signals CK2R, CK2C that are outputted from the signal generating circuit 100 and may output them to each SLED chip.

On the other hand, each SLED chip forming the SLED 63 according to the present exemplary embodiment is mainly composed of, for example, 128 pieces of thyristors S1 to S128 as a switch element, 128 pieces of LED L1 to L 128 as an example of a light source, 128 pieces of diodes D1 to D128, 128 pieces of resistances R1 to R128, and further, transfer current limitation resistances R1A and R2A for preventing excess current from being fed to signal lines ϕ1 and ϕ2.

Then, anode terminals (input terminals) A1 to A128 of respective thyristors S1 to S128 are connected to a power source line 55 and via the power source line 55, a drive voltage VDD (VDD=+3.3V) is supplied from the three-terminal regulator 101 (refer to FIG. 3) to the anode terminals A1 to A128.

On the other hand, gate terminals (control ends) G1 to G128 of respective thyristors S1 to S128 are connected to a power source line 56, respectively, via resistances R1 to R128 that are provided corresponding to respective thyristors S1 to S128 to be GND (grounded) via the power source line 56.

In addition, a transfer signal CK1 is sent from the signal generating circuit 100 and the level shift circuit 108 to cathode terminals (output terminals) K1, K3, . . . , K127 of an odd numbered thyristors S1, S3, . . . , S127 via a transfer current limitation resistance R1A. Then, a transfer signal CK2 is sent from the signal generating circuit 100 and the level shift circuit 108 to cathode terminals (output terminals) K2, K4, . . . , K128 of even numbered thyristors S2, S4, . . . , S128 via a transfer current limitation resistance R2A.

Further, cathode terminals of LED L1 to L 128 are connected to the signal generating circuit 100 and the lighting signal ϕI is sent to them.

Then, the signal generating circuit 100 may determine the transfer signals CK1R, CK1C and the transfer signals CK2R, CK2C from a high level (hereinafter, represented as "H" to a low level (hereinafter, represented as "L"), from "L" to "H" at predetermined timing, respectively. Thereby, the potential of the transfer signal CK1 to be outputted from the level shift circuit 108 is repeatedly determined from "H" to "L" and "L" to "H" and a potential of the transfer signal to be alternately outputted is repeatedly determined from "H" to "L" and from "L" to "H". Thereby, for example, in each SLED chip, the odd numbered thyristors S1, S3, . . . , S127 are allowed to carry out the transfer operation of off→on→off in series. In addition, the even numbered thyristors S2, S4, . . . , S128 are also allowed to carry out the transfer operation of off→on→off in series. Thereby, the thyristors S1 to S128 are allowed to carry out the transfer operation of off→on→off in series in the order of S1→S2→, . . . , →S127→S128, and in synchronization to this, the signal generating circuit 100 may output the lighting signal ϕI. Thereby, LED L1 to L128 are lighted in series in the order of L1→L2→ . . . , →L127→L128.

In this way, according to the LPH 14 of the present exemplary embodiment, in all SLED chips (CHIP 1 to CHIP 58) disposed in the LED circuit board 62, respective LEDs L1 to L128 are lighted in the order of L1→L2→ . . . ,→ L127→L128, and scanning and exposure on the basis of the image data are carried out for the photosensitive drum 12.

Thereby, according to the LPH 14 of the present exemplary embodiment, a basic configuration of wiring from the signal generating circuit 100 and the level shift circuit 108 into each SLED chip on the LED circuit board 62 is configured by two signal lines for sending the transfer signals CK1 and CK2 and one signal line for sending the lighting signal ϕI.

Subsequently, an optical system composed in the LPH 14 according to the present exemplary embodiment will be explained.

The LPH 14 according to the present exemplary embodiment may use the rod lens array 65 having a smaller opening angle than the conventional case, for example, which is formed as an angular aperture 9°. The opening angle herein means an angle of an incident pupil for an object point on an optical axis (the LED arranged on the SLED 63). Accordingly, for example, in the rod lens array 65 of an angular aperture 9°, the light inputted at an angle of not more than ±9° with respect to the optical axis attains to an image plane (the surface of the photosensitive drum 12) passing through the rod lens array 65.

Figure 5:
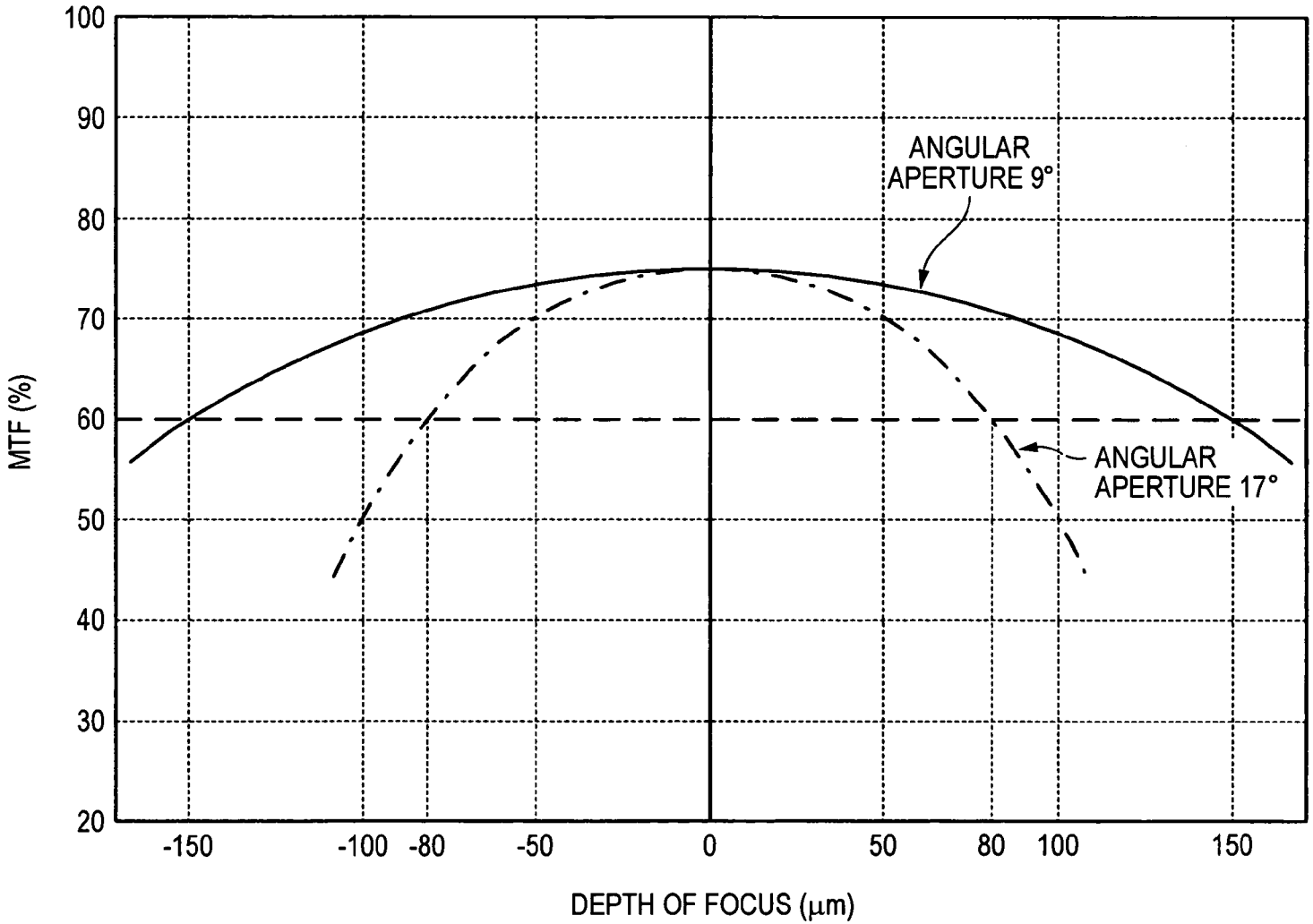
FIG. 5 is a view showing a relation between a depth of focus of a rod lens array and a MTF.

FIG. 5 is a view showing a relation between a depth of focus of the rod lens array 65 and Modulation Transfer Function (MTF). FIG. 5 shows the depths of focus of the rod lens arrays 65 of the opening angle 9° and the opening angle 17° by means of MTF for a spatial frequency 12 lp/mm (12 lines and 12 spaces per 1 mm are alternately formed).

As shown in FIG. 5, in the case of using the conventional rod lens array 65 of the opening angle 17°, the depth of focus for realizing MTF≧60% is ±80 μm. On the contrary, in the case of using the rod lens array 65 according to the present exemplary embodiment of the opening angle 9°, the depth of focus for realizing MTF≧60% is enlarged into ±150 μm. According to the LPH 14 of the present exemplary embodiment, making the opening angle of the rod lens array 65 smaller into, for example, 9°, a large depth of focus larger than the conventional case, for example, ±150 μm is determined.

In addition, according to the LPH 14 of the present exemplary embodiment, for example, the rod lens array 65 having an working distance that is larger than the conventional one, for example, 14 mm or about 14 mm is used. The working distance herein means a distance from the output surface of the rod lens array 65 (the surface at the side of the photosensitive drum 12) to a focal position at the image side (the surface of the photosensitive drum 12). According to the rod lens array 65 of the present exemplary embodiment, by appropriately adjusting an opening diameter in each rod lens configuring the rod lens array 65 and a distribution of a refraction index or the like in a radial direction around the optical axis, its working distance is made 14 mm or about 14 mm.

In this way, according to the LPH 14 of the present exemplary embodiment, by determining the depth of focus larger, for example, ±150 μm or about ±150 μm using, for example, the rod lens array 65 of the opening angle 9° or about 9°, a degree of arrangement accuracy of the rod lens array 65 is eased. Further, by using, for example, the rod lens array 65 of the working distance 14 mm or about 14 mm, the rod lens array 65 is arranged so as to be largely separated from the photosensitive drum 12.

Thereby, when attaching and detaching a photosensitive module MOD to and from the main body of the image forming apparatus 1, it is not necessary to provide a mechanism for separating the LPH 14 from the photosensitive module MOD (a so-called retract mechanism). In addition, the LPH 14 may realize the configuration that is not easily deteriorated by a toner or the like, and further, an arrangement space for a member for cleaning the LPH 14 when the LPH 14 is deteriorated by a toner or the like is secured.

Figure 6:
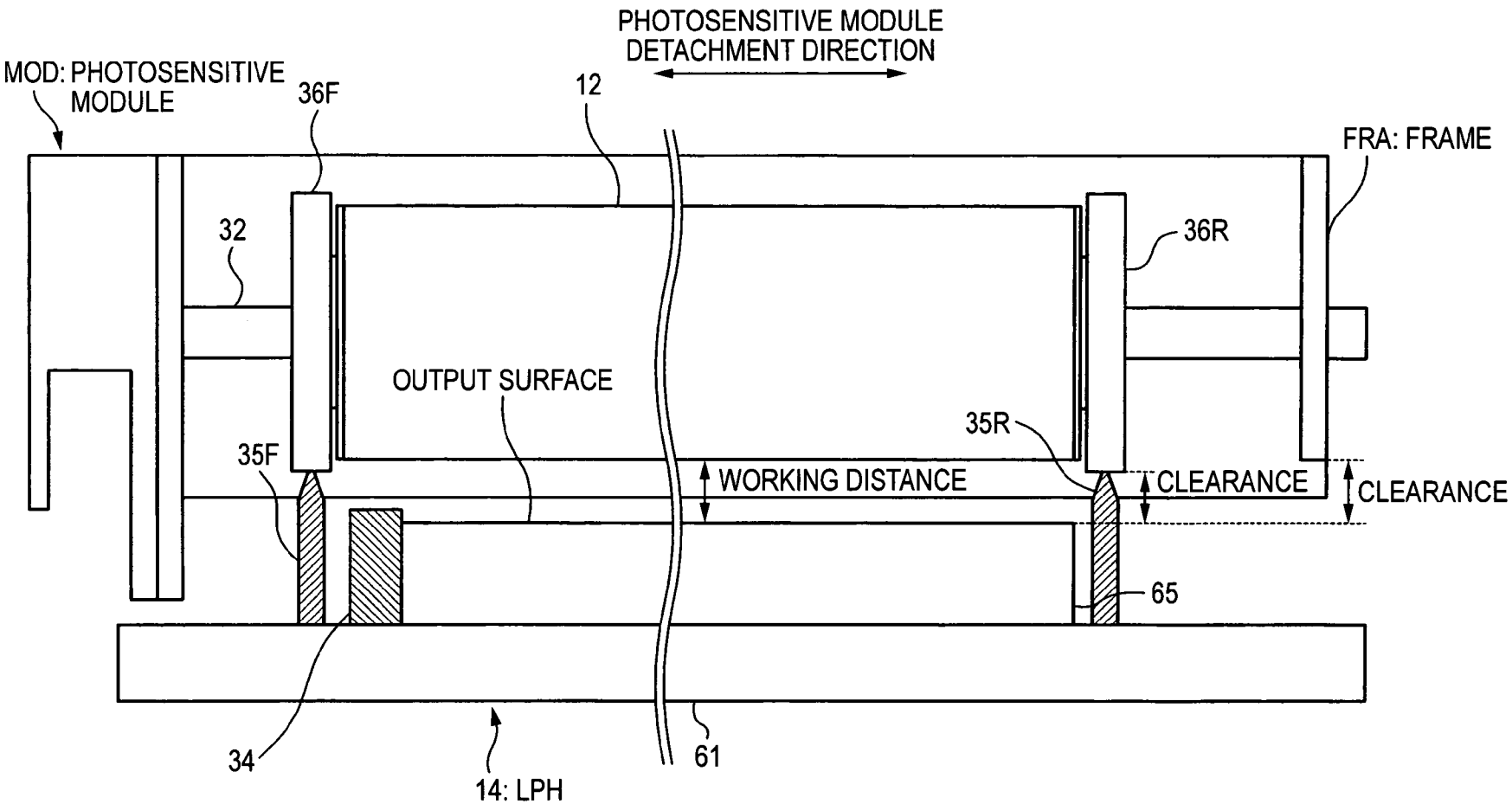
FIG. 6 is a view a view showing the state that a photosensitive module MOD is disposed on a main body of an image forming apparatus.

Here, FIG. 6 is a view showing the state that the photosensitive module MOD is disposed on the main body of the image forming apparatus 1. In FIG. 6, a left side of the drawing is a front face side of the image forming apparatus 1 and this is the side on which the photosensitive module MOD is detachably operated. In addition, a right side of the drawing is a rear face side of the image forming apparatus 1 and this is the side on which driving from the drive motor rotatably driving is transmitted to the photosensitive drum 12 or the like. Further, according to the present specification, it is defined that "F" is attached to the end of a number of a member that is arranged at the front face side and "R" is attached to the end of a number of a member that is arranged at the rear side with respect to the member having the same function.

As shown in FIG. 6, on the housing 61 of the LPH 14 according to the present exemplary embodiment, abutting members 35F and 35R for determining a position in the optical axial direction of the rod lens array 65 in the LPH 14 are arranged. On the other hand, in the photosensitive module MOD for supporting the photosensitive drum 12, by abutting the abutting members 35F and 35R on the side of the LPH 14 in the same axis as a rotational axis 32 of the photosensitive drum 12, positioning members 36F and 36R for determining the optical axial directional position of the rod lens array 65 are arranged. Further, in FIG. 6, a member for positioning the LPH 14 into two directions other than the optical axial directional position, namely, a direction of the rotational axis 32 of the photosensitive drum 12 and a sub-scan direction of the photosensitive drum 12 is omitted.

Since the rod lens array 65 according to the present exemplary embodiment has a large working distance, for example, 14 mm, it is possible to determine a distance (a clearance) between the output surface of the rod lens array 65 and the positioning member 36R that is arranged on the rear face side of the photosensitive module MOD and a distance (a clearance) between the output surface of the rod lens array 65 and a frame FRA that is arranged on the rear face side of the photosensitive module MOD longer. Therefore, when carrying out the attaching and detaching operation of the photosensitive module MOD, the positioning member 36R that is arranged on the rear face side and the frame FRA that is arranged on the rear face side of the photosensitive module MOD are prevented from interfering with the rod lens array 65. Thereby, it becomes unnecessary to provide the retract mechanism for separating the LPH 14 from the photosensitive module MOD.

In addition, by having the large working distance of 14 mm, a space arranging a cleaning member 34 for cleaning the output surface of the rod lens array 65 is formed between the rod lens array 65 and the photosensitive drum 12. In addition, since a distance between the output surface of the rod lens array 65 and the photosensitive drum 12 is large, a toner cloud in the vicinity of the surface of the photosensitive drum 12 is hardly attached to the output surface of the rod lens array 65.

Further, since the depth of focus of the rod lens array 65 is determined large, for example, ±150 μm or about 150 μm, lowering of a resolution of a latent image formed on the photosensitive drum 12 caused by a displacement in the optical axial direction of the rod lens array 65 is prevented. As a result, when abutting the abutting members 35F and 35R on the side of the LPH 14 and the positioning members 36F and 36R on the side of the photosensitive module MOD each other, even in the displacement is caused in the optical axial direction of the rod lens array 65, an allowable range for such a displacement is enlarged. Therefore, it becomes unnecessary to dispose a mechanism for positioning the LPH 14 on the photosensitive module MOD with a high degree of accuracy.

Subsequently, the configuration for preventing decrease in a light amount to enter the rod lens array 65 by using the rod lens array 65 of which opening angle is small, for example, 9° or about 9° and of which working distance is large, for example, 14 mm in the LPH 14 according to the present exemplary embodiment will be described.

As shown in FIG. 2, according to the LPH 14 of the present exemplary embodiment, disposing the condenser lens 64 between the SLED 63 and the rod lens array 65, the condenser lens 64 is arranged in accordance with a predetermined setting condition to be described below in a positional relation between the LED to be arranged in the SLED 63 and the rod lens array 65. Thereby, an optical system to prevent decrease in the incident light amount into the rod lens array 65 related to the fact that the output angle of the output light from the LED that can enter the rod lens array 65 is limited by a narrow opening angle of the rod lens array 65 and the fact that the output light from the LED is prevented from spreading because the working distance is long, namely, 14 mm is realized.

At first, as a first setting condition, the condenser lens 64 is arranged so as to contact the light emitting surface of the LED related to each LED arranged in the SLED 63.

Figure 7A:
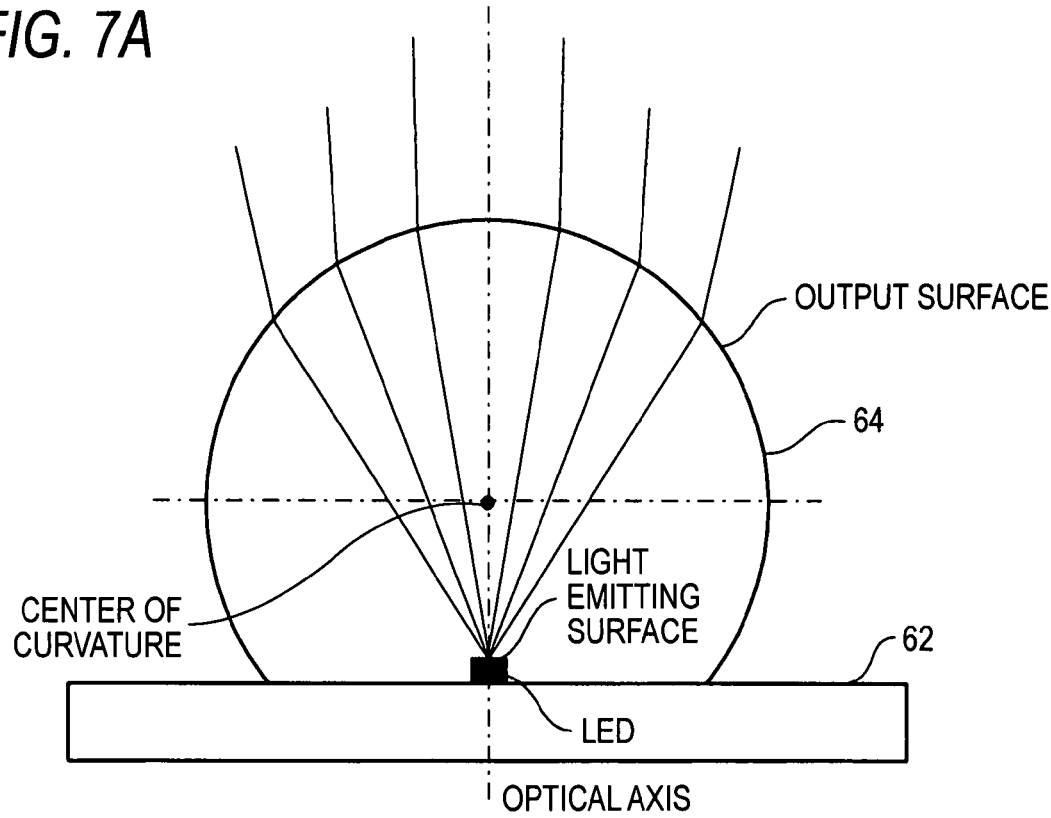
FIGS. 7A and 7B are views for comparing the states that the output light from the LED enters a condenser lens.
Figure 7B:
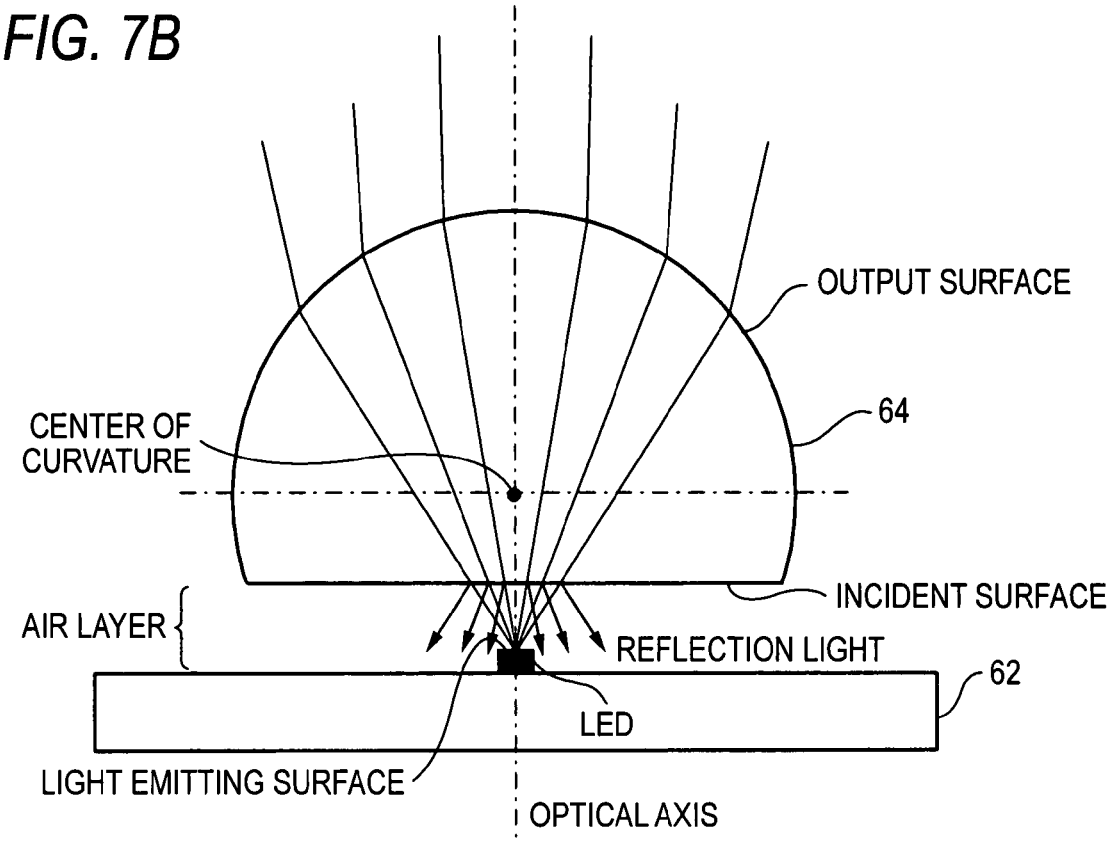

FIGS. 7A and 7B are views for comparing the states that the output light from the LED arranged in the SLED 63 (hereinafter, may be merely referred to as "LED") enters the condenser lens 64. FIG. 7A shows the case that the condenser lens 64 is arranged so as to contact the light emitting surface of the LED and FIG. 7B shows the case that the condenser lens 64 is arranged so as to be separated from the light emitting surface of the LED. As shown in FIG. 7A, in the case that the condenser lens 64 is arranged so as to contact the light emitting surface of the LED, almost of the output light from the LED passes through the inside of the condenser lens 64 to be outputted from the output surface in a direction of the photosensitive drum 12. On the contrary, as shown in FIG. 7B, in the case that the condenser lens 64 is arranged so as to be separated from the light emitting surface of the LED, an air layer is formed between the condenser lens 64 and the LED, so that a part of the output light from the LED is reflected on the incident surface of the condenser lens 64. Thereby, the light amount of the light to be emitted from the output surface in a direction of the photosensitive drum 12 passing through the interior part of the condenser lens 64 is decreased by the amount of the reflection light.

In this way, decrease of the light amount of the light to be emitted from the output surface of the condenser lens 64 in a direction of the photosensitive drum 12 is prevented by arranging the condenser lens 64 so as to contact the light emission surface of the LED in the LPH 14 according to the present exemplary embodiment.

As a second setting condition, the LED is arranged being separated from the output surface of the condenser lens 64 (hereinafter, referred to as "a curvature center") further from a center of curvature of the output surface of the condenser lens 64.

Figure 8A:
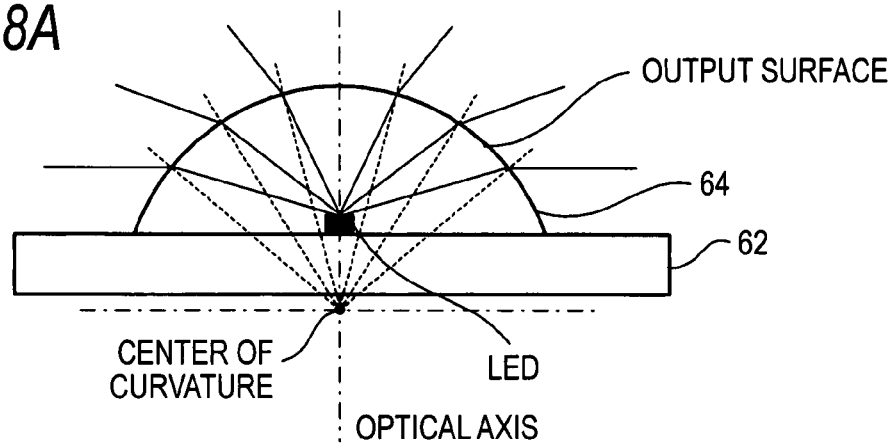
FIGS. 8A to 8C are views for comparing light paths of a light emitted from an output surface of the condenser lens.
Figure 8B:
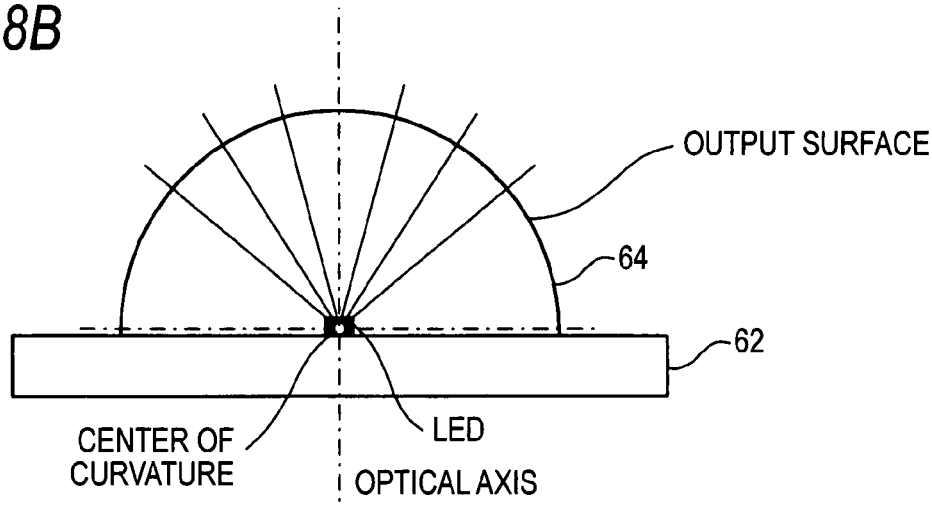
Figure 8C:
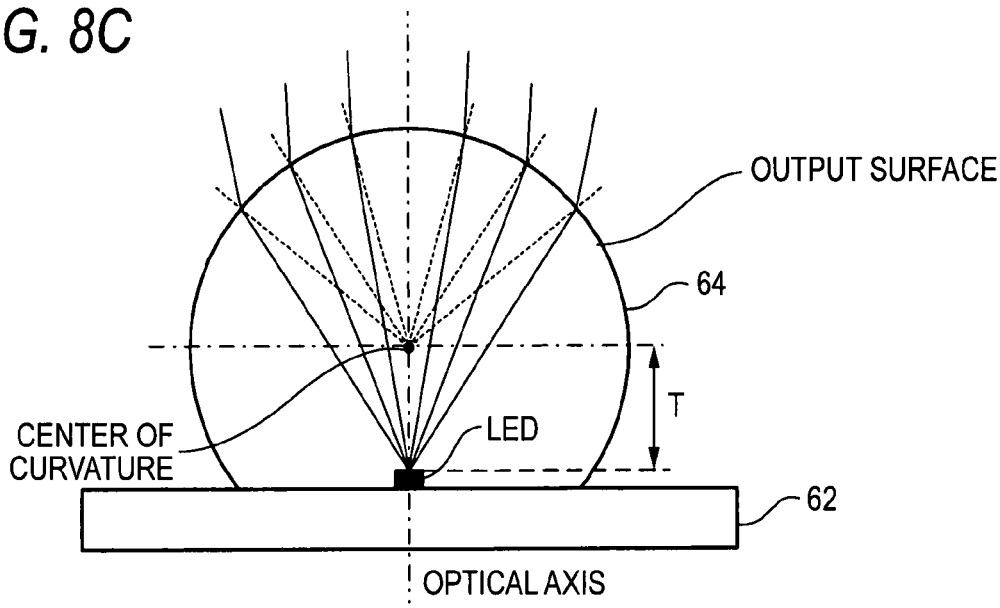

FIGS. 8A to 8C are views comparing light paths of a light emitted from an output surface of the condenser lens 64. FIG. 8A shows the case that the LED is arranged on the position at the side of the output surface further from the center of curvature, FIG. 8B shows the case that the LED is arranged on the position of the center of curvature, and FIG. 8C shows the case that the LED is arranged on the position separated from the output surface further from the center of the curvature.

As shown in FIG. 8A, in the case that the LED is arranged on the position on the side of the output surface further from the center of curvature, the light emitted from the LED enters the output surface of the condenser lens 64 from the side of the optical axis further from a normal line (a broken line in the drawing) on the output surface with respect to the output surface of the condenser lens 64. Thereby, on the output surface of the condenser lens 64, a light emitted from the LED is deflected in a direction that the light spreads. Therefore, the light entering the rod lens array 65 of the opening angle 9° or about 9° among the lights emitted from the LED is made into a light of which output angle from the LED is smaller than a range of ±9° or about ±9° and the light amount of the incident light to the rod lens array 65 is decreased.

In addition, as shown in FIG. 5B, in the case that the LED is arranged on the center of the curvature, the light emitted from the LED enters the output surface of the condenser lens 64 along the normal line (a broken line in the drawing) and is emitted along the normal line. In other words, the incident angle to the output surface of the condenser lens 64 is identical with the output angle from the output surface. Therefore, the light entering the rod lens array 65 of the opening angle 9° or about 9° among the lights emitted from the LED is made into a light of which output angle from the LED is within a range of ±9° or about ±9° and the light amount of the incident light to the rod lens array 65 is not increased.

On the contrary, as shown in FIG. 8C, in the case that the LED is arranged at the position separated from the output surface further from the center of curvature, the light emitted from the LED enters the output surface of the condenser lens 64 from the opposite side of the optical axial side further from the normal line of the output surface (the broken line in the drawing) with respect to the output surface of the condenser lens 64. Thereby, on the output surface of the condenser lens 64, the light emitted from the LED is deflected in a direction that the light is focused. Therefore, the light entering the rod lens array 65 of the opening angle 9° or about 9° among the lights emitted from the LED is made into a light of which output angle from the LED is larger than a range of ±9° or about ±9° and the light amount of the incident light to the rod lens array 65 is increased.

In this way, in the LPH 14 according to the present exemplary embodiment, by arranging the LED on the position separated from the output surface further from the center of curvature of the condenser lens 64, a light of which output angle from the LED is larger than a range of ±9° or about ±9° enters the rod lens array 65 so as to increase the light amount of the incident light to the rod lens array 65.

Next, increase of the incident light to the rod lens array 65 due to the operation of the condenser lens 64 in the case of arranging the LED on the position separated from the output surface further from the center of curvature of the condenser lens 64 will be described in detail.

Figure 9A:
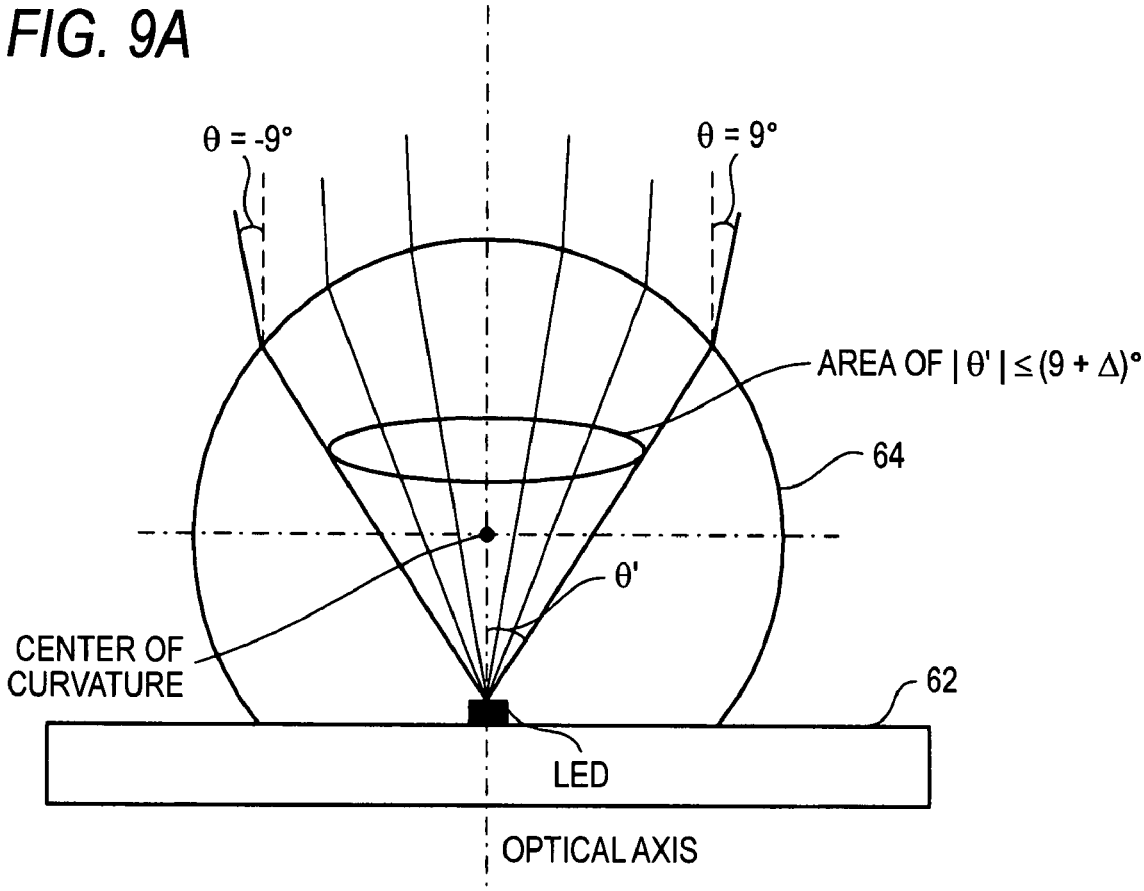
FIGS. 9A and 9B are views for explaining an incident light amount into the rod lens array.
Figure 9B:
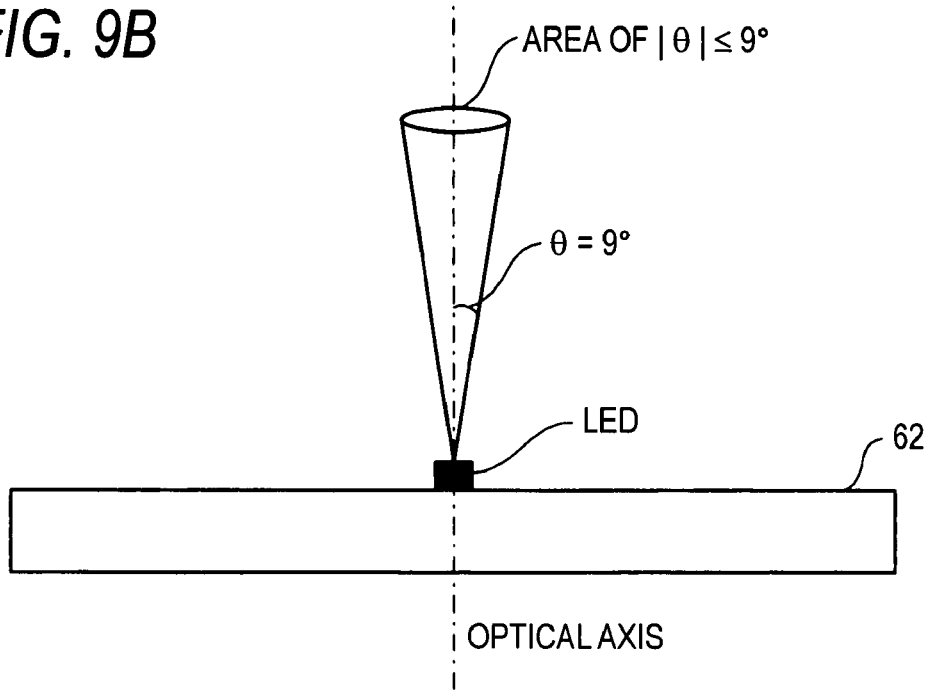

FIGS. 9A and 9B are views for explaining an incident light amount to the rod lens array 65. FIG. 9A shows an output angle of the light from the LED entering the rod lens array 65 of the opening angle 9° or about 9° when the condenser lens 64 is arranged and FIG. 9B shows an output angle of the light from the LED entering the rod lens array 65 of the opening angle 9° or about 9° when the condenser lens 64 is not arranged.

At first, as shown in FIG. 9B, when the condenser lens 64 is not arranged, since the opening angle of the rod lens array 65 is 9° or about 9°, the light emitted in the range (the area of $|\theta| \leqq 9°$ or about 9° in the drawing) of the output angle ±9° or about ±9° enters the rod lens array 65.

On the contrary, as shown in FIG. 9A, if the LED is arranged on the position that is separated from the output surface further from the center of curvature, on the output surface of the condenser lens 64, the light emitted from the LED is deflected in a direction that the light is focused (also refer to FIG. 8C). Therefore, when the condenser lens 64 is arranged, the light emitted from the LED within the range of an output angle $\theta' = \pm(9+\Delta)°$ ($\Delta>0$) (namely, the area of $|\theta'| \leqq (9+\Delta)°$) in the drawing) enters the rod lens array 65 of the opening angle 9° or about 9°. Thereby, in the case that the LED is arranged on the position separated from the output surface further from the center of curvature of the condenser lens 64, the light emitted at a larger output angle θ' than the output angle ±9° or about ±9° from the LED also enters the rod lens array 65, and as compared to the case that the condenser lens 64 is not arranged, the incident light amount to the rod lens array 65 is increased.

Figure 10:
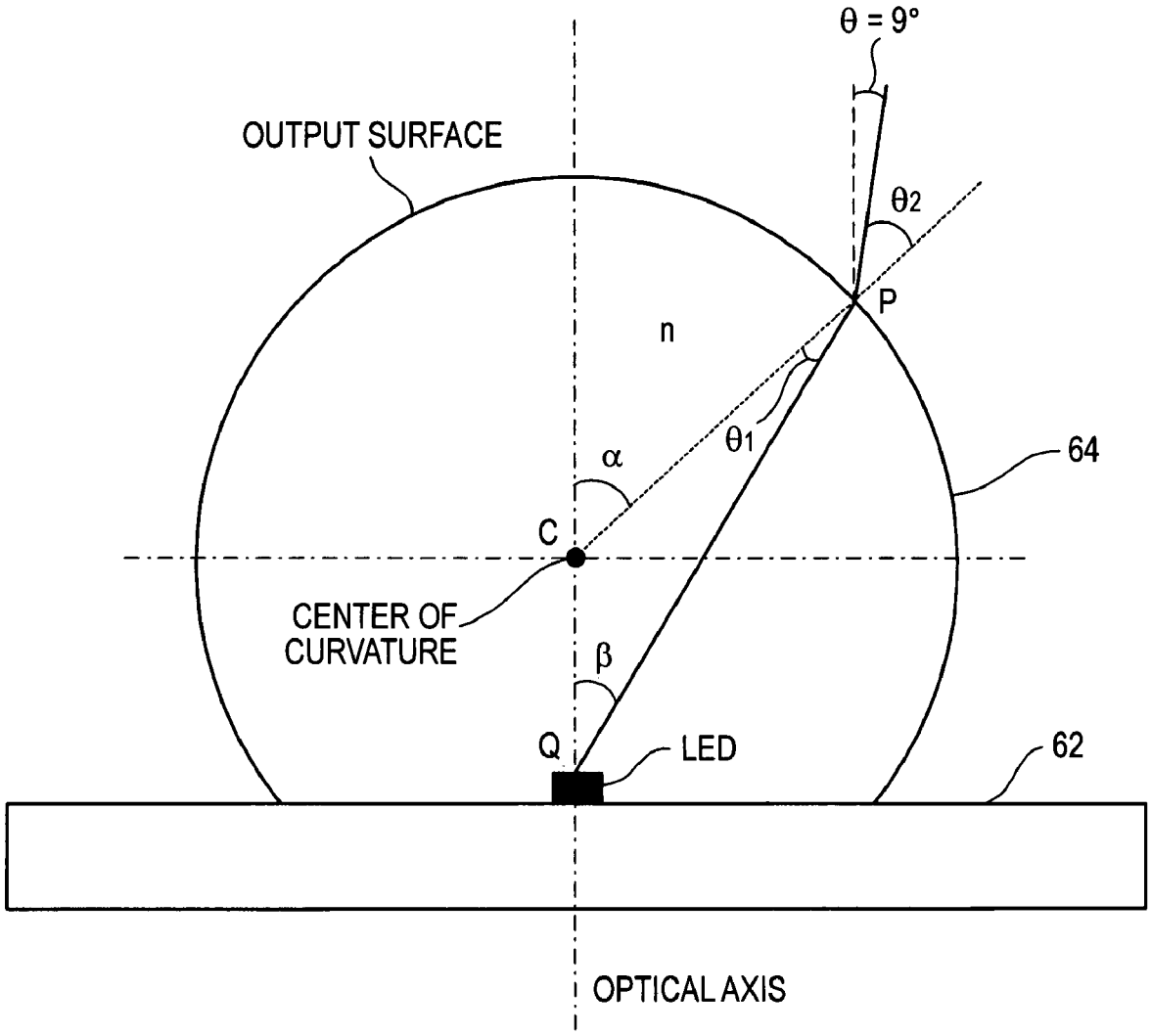
FIG. 10 is a view showing a light path in the condenser lens of the light that enters the rod lens array at an incident angle 9°.

Here, FIG. 10 is a view showing a light path in the condenser lens 64 of the light that enters the rod lens array 65 at an incident angle 9° or about 9°. In FIG. 10, the position of the LED on the optical axis is defined as Q, the position of the light entering the rod lens array 65 at an incident angle 9° or about 9° on the output surface is defined as P, and the center of curvature of the condenser lens 64 is defined as C. In addition, an angle made by the normal line (the broken line in the drawing) and the optical axis on a position P is defined as α, the output angle from the LED is defined as β(=θ' of FIG. 9A), the incident angle on the position P is defined as θ1, the output angle is defined as θ2, and a refraction index of the condenser lens 64 is defined as n. From an inner angle of a triangle CPQ shown in FIG. 10, $$\theta 1+\beta=\alpha \tag{1}$$

Further, $$\alpha=9+\theta 2 \tag{2}$$

Accordingly, from a formula (1) and a formula (2), $$\beta=9+(\theta 2-\theta 1) \tag{3}$$

On the other hand, from a Snell's law, defining a refraction index of air is defined as 1, $$n \cdot \sin \theta 1=\sin \theta 2 \tag{4}$$

Since a refraction index n such as a resin and glass that is a material of the condenser lens 64 is generally n=1.4 or about 1.4 to 1.8 or about 1.8, from a formula (4), a relation of θ2>θ1 is established. As a result, in the formula (3), θ2−θ1>0 or about 0 is established, so that β>9 or about 9 is established. Accordingly, the light emitted at a larger output angle than the output angle ±9° or about ±9° can also enter the rod lens array 65 of the opening angle 9° or about 9°.

It is assumed that the LED is arranged on the position that the incident angle θ1 is 15° or about 15°, for example. In this case, assuming that the condenser lens 64 using a material of n=1.6 is used, since sin 15°=0.2588 is established, from the formula (4), 1.6×0.2588=sin θ2 is established.

Accordingly, in this case, θ2=24.1° is established and θ2−θ=9° is established, from the formula (3), the output angle β from the LED=18° is established. In other words, in the rod lens array 65 of the opening angle 9°, the light of the output angle 18° from the LED can be used. This means that the light amount equivalent to the case of using the rod lens array 65 of the opening angle 18° can be used.

In this way, by appropriately determining the arrangement position of the LED and a curvature and the refraction index n or the like of the condenser lens 64, it is possible to allow the light amount the same as the case of using the conventional rod lens array 65 of the opening angle 17° or the light amount more than that to enter the rod lens array 65. Particularly, from a viewpoint of increasing the incident light amount to the rod lens array 65, it is preferable that a distance between the LED and the center of curvature is largely determined so as to increase the incident angle θ1 and the condenser lens 64 is configured by a material whose refraction index n is large.

As a third setting condition, it is preferable that the LED is arranged on the position at the side of the output surface further from the focal point position at the object side of the condenser lens 64. Further, a setting condition following the third setting condition is a preferable condition for further preventing decrease of the incident light amount into the rod lens array 65 by setting this condition in addition to the first setting condition and the second setting condition.

Figure 11:
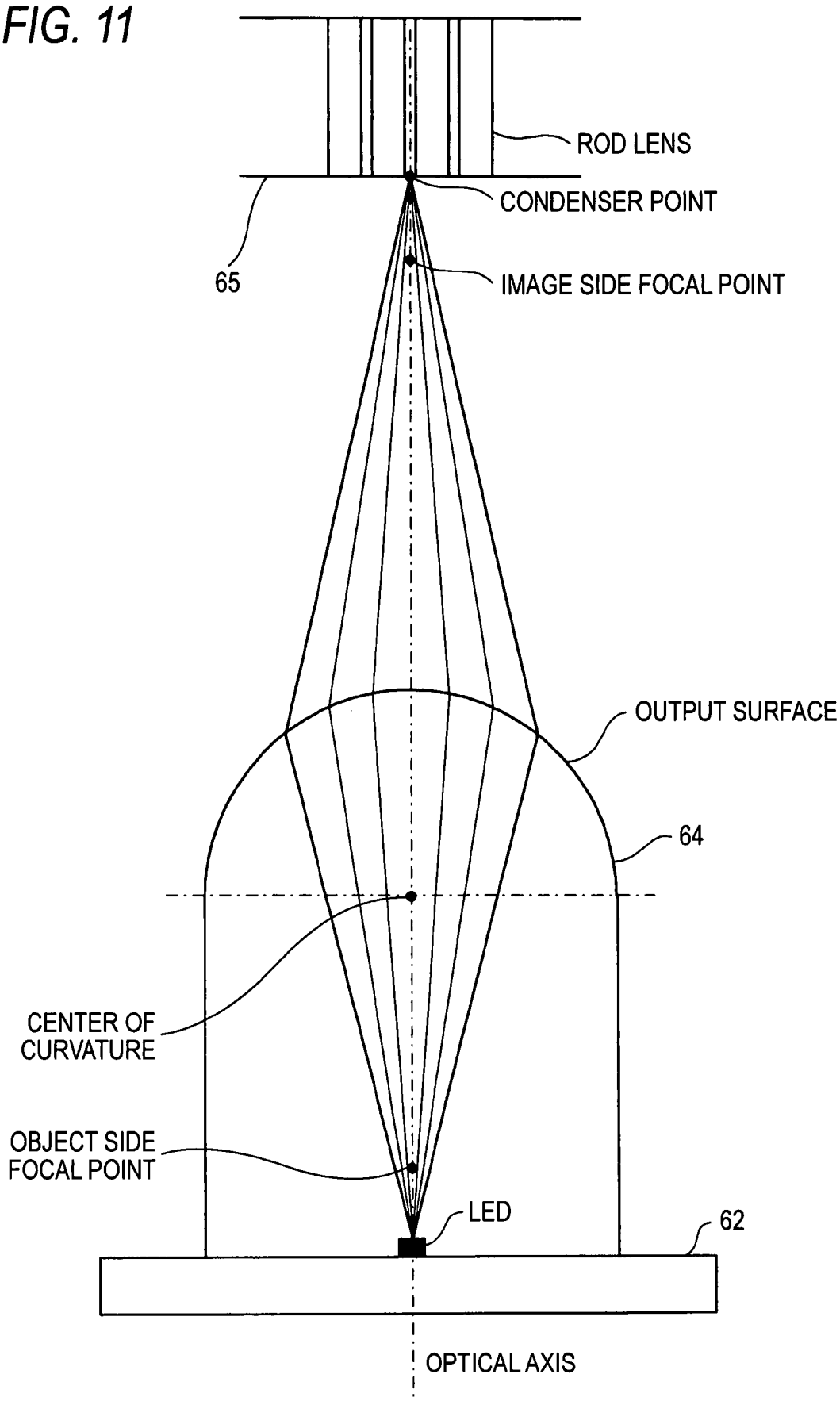
FIG. 11 is a view showing a light path of a light to be emitted from an output surface of the condenser lens in the case of arranging the LED on a position separated from the output surface further from a focal point at the object side of the condenser lens.

FIG. 11 is a view showing a light path of a light to be emitted from an output surface of the condenser lens 64 in the case of arranging the LED on a position separated from the output surface further from a focal point at the object side of the condenser lens 64. As shown in FIG. 11, in the case that the LED is arranged on a position separated from the output surface further from a focal point at the object side of the condenser lens 64, the light emitted from the output surface of the condenser lens 64 may be condensed on the incident surface of the rod lens array 65. In this time, in the case that the condenser point on the incident surface of the rod lens array 65 is located between the rod lens and the rod lens, the light from the LED is not enter the rod lens. Thus, the light amount of the incident light into the rod lens array 65 is decreased.

On the contrary, in the case that the LED is arranged on the position at the side of the output surface further from the focal position at the object side of the condenser lens 64, the light emitted from the output surface of the condenser lens 64 is deflected in a direction that the light spreads (refer to FIG. 8C), so that this light is not condensed at the side of the condenser lens 64 further from the rod lens array 65.

Thus, in the LPH 14 according to the present exemplary embodiment, by arranging the LED on the position at the side of the output surface further from the focal point at the object side of the condenser lens 64, it is possible to prevent generation of the state that the light from the LED cannot enter the rod lens and decrease of the light amount of the incident light into the rod lens array 65 is prevented.

Here, an optical mode that the light emitted from the outside point (the output point) of the condenser lens 64 produces an image within the condenser lens 64 is considered. In such an optical model, the relation of the following formula (5) is established between the output point and the imaging point within the condenser lens 64. In other words, assuming that a curvature radius of the condenser lens 64 is defined as R, a refraction index of the condenser lens 64 is defined as n, a refraction index of a space at the side of the output point is defined as n', a distance between the output point and the surface of the condenser lens 64 is defined as L1, and a distance between the surface of the condenser lens 64 (the output surface) and the imaging point is defined as L2, $$n'/L1+n/L2=(n-n')/R \tag{5}$$

Accordingly, in the case that the output point is located in air (n'=1), from the formula (5), a distance F (=L2) between the output surface of the condenser lens 64 and the focal point of the condenser lens 64 is represented as follows; namely, $$F=nR/(n-1) \tag{6}$$

where L1=∞

As a result, in the case of satisfying the third setting condition, from the formula (6), LED is arranged on the position within nR/(n−1) from the output surface of the condenser lens 64.

In addition, in the case that a distance between the arrangement position of the LED and the center of curvature of the condenser lens 64 is defined as T (refer to FIG. 8C) and a direction separated from the output surface of the condenser lens 64 is defined as positive (+), the above-described second setting condition is T>0. Therefore, in the case of setting so as to satisfy both of the second setting condition and the third setting condition, from the formula (6), $$0<T<nR/(n-1)-R$$

In other words, $$0<T<R/(n-1) \tag{7}$$

Accordingly, in the LPH 14 according to the present exemplary embodiment, in the case of setting both of the second setting condition and the third setting condition, the LED is arranged on the position of the distance T from the center of curvature or the condenser lens 64 satisfying the formula (7).

Next, as the fourth setting condition, it is preferable that the LED is arranged so that the light emitted when an absolute value is not more than 9° with respect to the optical axis from the output surface of the condenser lens 64 is emitted from the area that the intensity of the output light of the LED becomes not less than ½ of the light intensity in an optical axial direction that the intensity of the output light of the LED becomes the highest.

Figure 12:
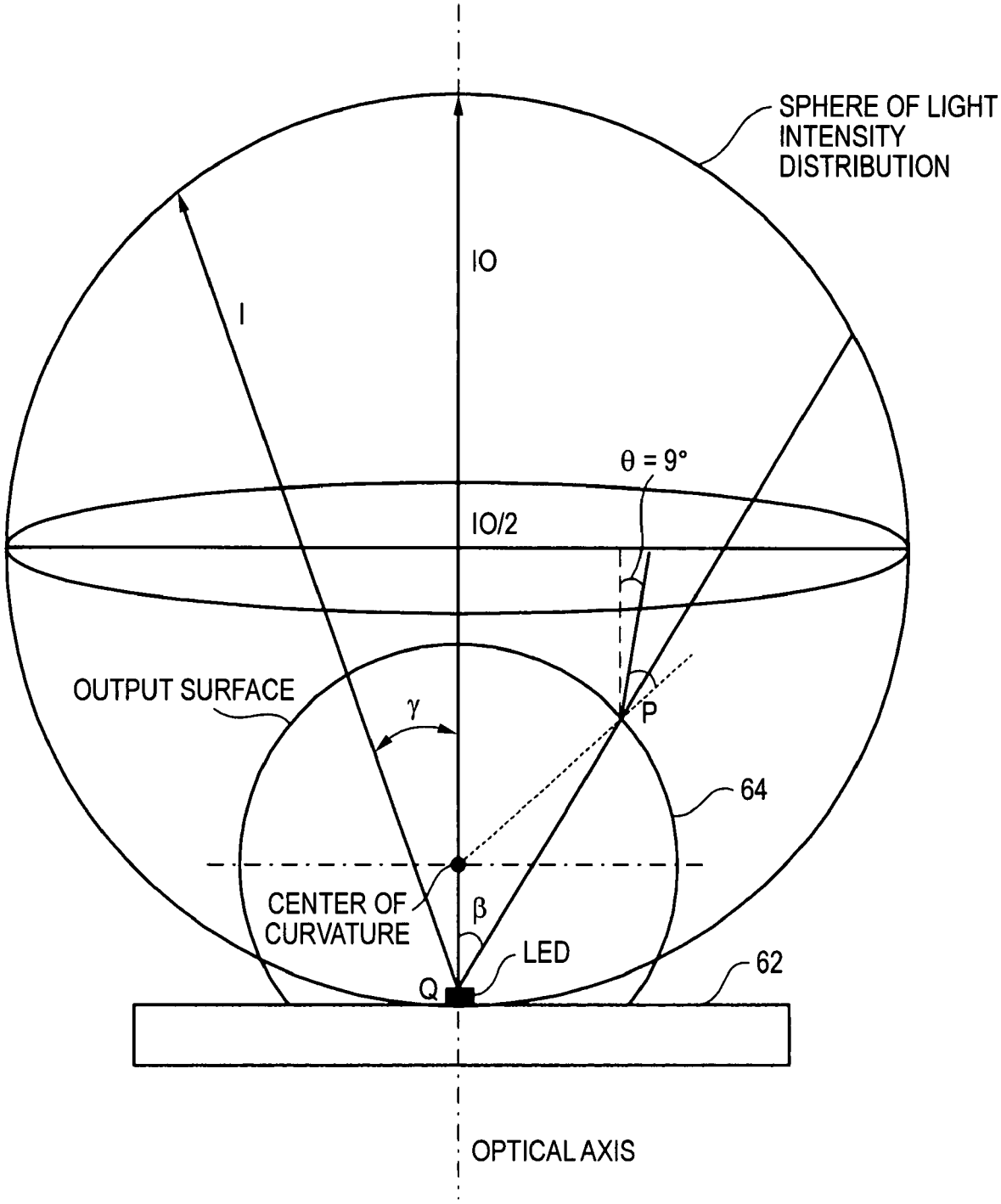
FIG. 12 is a view showing a relation between a light intensity I for emitting the LED and an output angle γ emitted from the LED.

FIG. 12 is a view showing a relation between a light intensity I for emitting the LED and an output angle γ emitted from the LED. As shown in FIG. 12, generally, the light intensity I emitted from the LED is determined by a direction of the output angle γ, and the light intensity I for the output angle γ forms a sphere having an optical axis passing through the LED that is an ignition point as a diameter. Therefore, as shown in FIG. 12, in the area that that the intensity of the output light of the LED becomes not more than ½ of the light intensity in an optical axial direction that the intensity of the output light of the LED becomes the highest, namely, in the lower hemisphere of the sphere, the light intensity I is small.

Therefore, in the LPH 14 according to the present exemplary embodiment, it is preferable that the LED is arranged so that the light emitted not more than 9° with respect to the optical axis from the output surface of the condenser lens 64 is emitted from the upper hemisphere of the sphere shown in FIG. 12, namely, the area that the intensity of the output light of the LED becomes not less than ½ of the light intensity in an optical axial direction that the intensity of the output light of the LED becomes the highest. Thereby, the output light from the LED is efficiently used.

As a fifth setting condition, it is preferable that an aperture 68 for shielding the light emitted from the output surface of the condenser lens 64 at an output angle having an absolute value larger than 9° or about 9° with respect to the optical axis is arranged.

Figure 13:
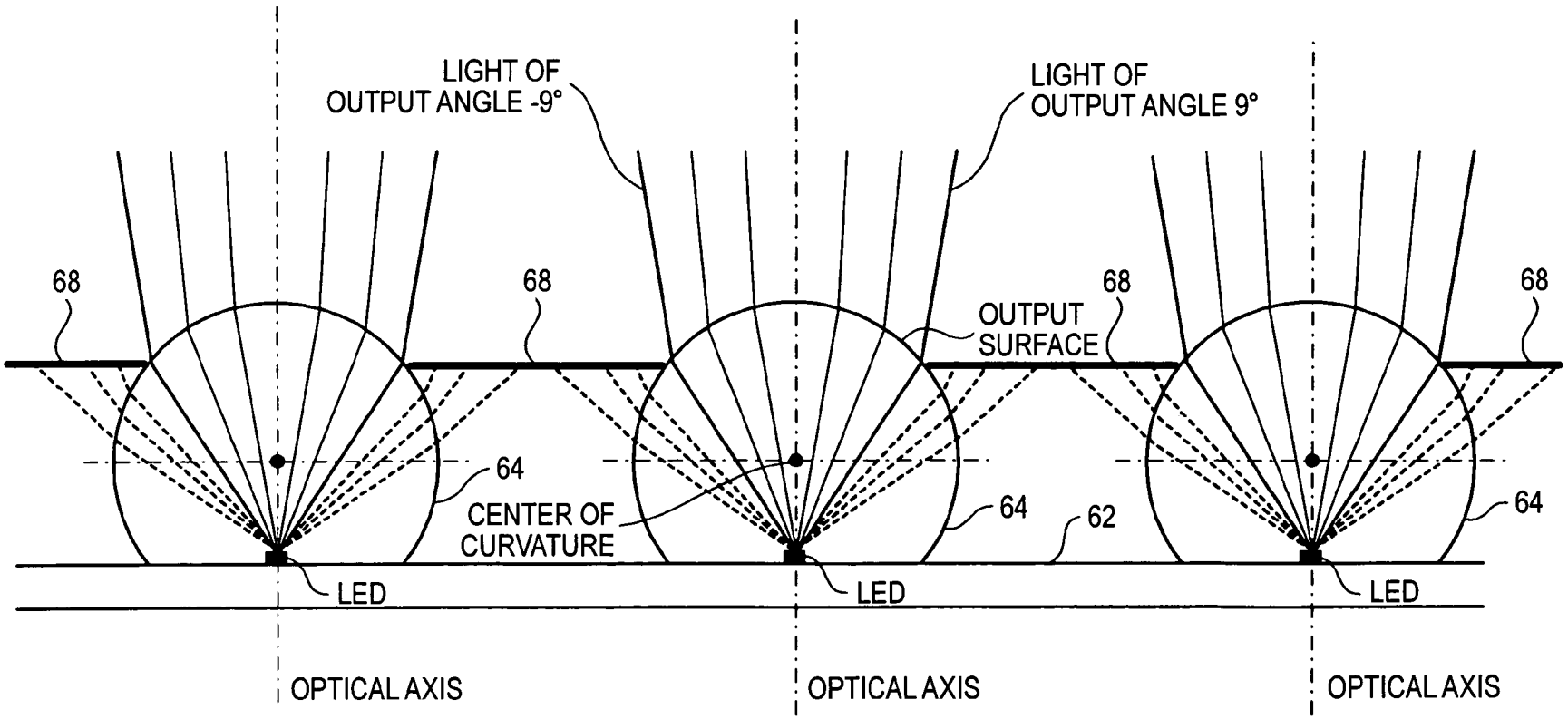
FIG. 13 is a view for explaining an aperture.

FIG. 13 is a view for explaining an aperture 68 according to the present exemplary embodiment. As shown in FIG. 13, in the LPH 14 according to the present exemplary embodiment, the aperture 68 for shielding the light emitted at the output angle having an absolute value larger than 9° or about 9° is arranged between one condenser lens 64 and other condenser lens 64. The light to be emitted at the output angle having the absolute value larger than 9° or about 9° a does not enter the rod lens array 65 of the opening angle 9° or about 9° directly, however, it may be assumed that the light is reflected on the output surface or the like of the condenser lenses 64 to enter the rod lens array 65. In this case, due to a cross talk caused by the reflection light, for example, a defect of an image such as a disturbance and bleeding or the like of an image may be generated.

Therefore, in order to prevent generation of a defect of an image due to a cross talk, it is preferable that the aperture 68 for shielding the light emitted at the output angle having an absolute value larger than 9° or about 9° is arranged between one condenser lens 64 and other condenser lens 64.

As a sixth setting condition, it is preferable that the light from each LED emitted from the output surface of the condenser lenses 64 to the optical axis at ±9° or about ±9° is arranged on the incident surface of the rod lens array 65 so as not to be beyond the range that the rod lens in adjacent to the rod lens positioned on the optical axis of the LED.

Figure 14A:
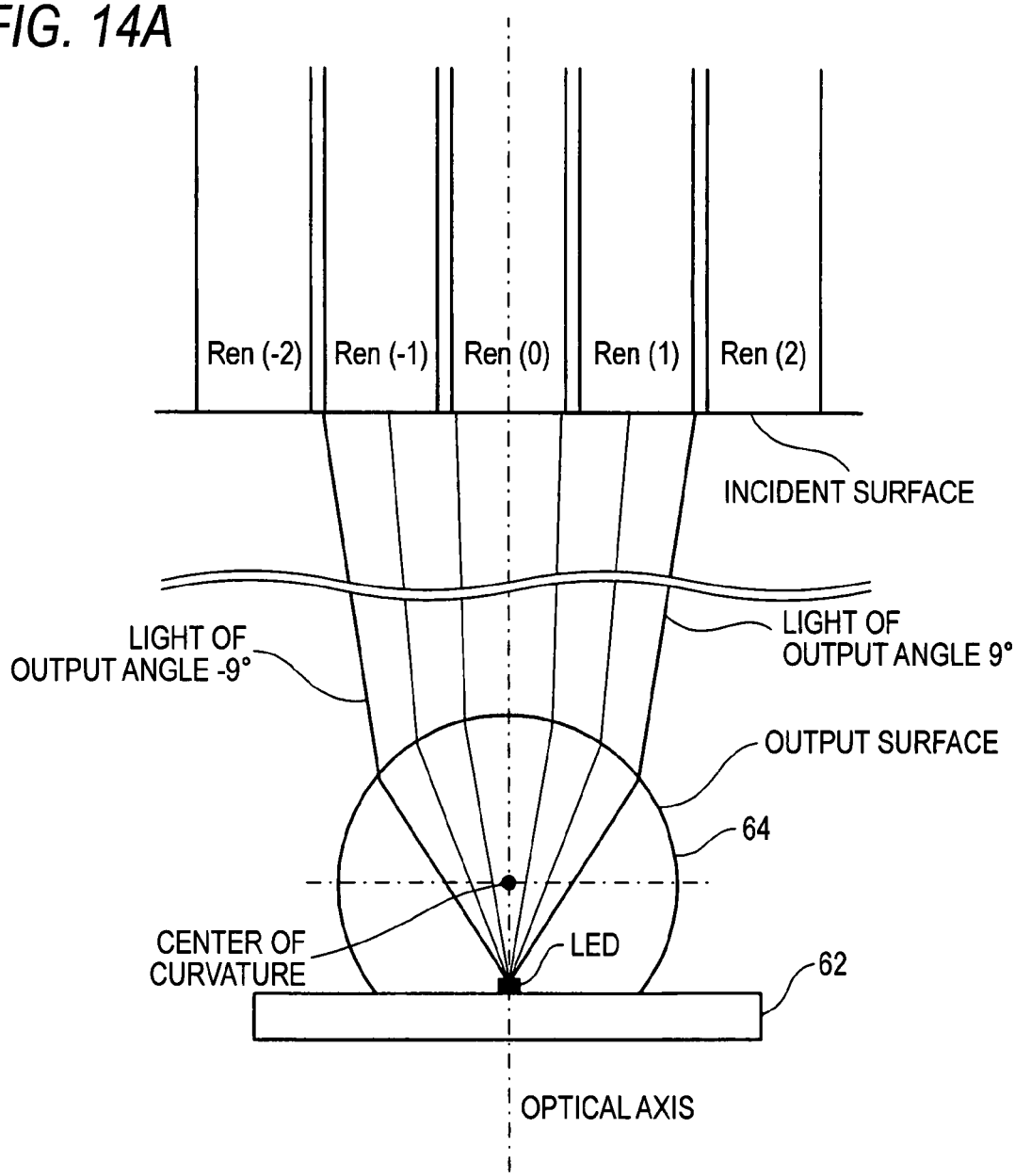
FIG. 14A is a view for showing a light path of a light from the LED that is emitted from the output surface of the condenser lens at ±9° with respect to the optical axis.
Figure 14B:
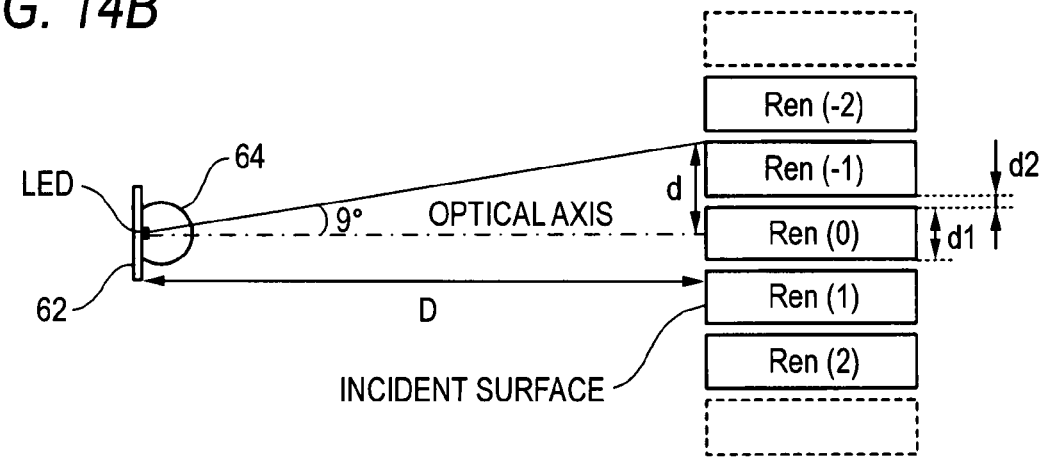
FIG. 14B is a view for explaining a condition that the light from the LED is not beyond the range that the rod lens in adjacent to the rod lens that is positioned on the optical axis of the LED is positioned.

FIG. 14A is a view for showing a light path of a light from the LED that is emitted from the output surface of the condenser lens 64 at ±9° or about ±9°. FIG. 14B is a view for explaining a condition that the light from the LED is not beyond the range that the rod lens in adjacent to the rod lens that is positioned on the optical axis of the LED is positioned.

In FIG. 14A, a rod lens Ren (0) is positioned on the optical axis of the LED, and in adjacent to the rod lens Ren (0), a rod lens Ren (1) and a rod lens Ren (−1) are positioned. Further, in adjacent to these rod lenses Ren (1) and Ren (−1), a rod lens Ren (2) and a rod lens Ren (−2) are positioned. In this case, in the LPH 14 according to the present exemplary embodiment, the light from the LED that is emitted from the output surface of the condenser lenses 64 to the optical axis at ±9° is configured so as not to be beyond the position where the rod lens Ren (1) and the rod lens Ren (−1) are arranged. In other words, this light from the LED is configured so as not to reach the position where the rod lens Ren (2) and the rod lens Ren (−2) are arranged.

As configured in this way, the light emitted from the LED is prevented from spreading over the opposed rod lens Ren (0) and the rod lens Ren (1) and the rod lens Ren (−1) in adjacent to this rod lens Ren (0). Thereby, when the lights emitted form the LED pass through many rod lenses Ren having dispersion in an image producing property, respectively, dispersion of the output light amount in an arrangement direction from the rod lens array 65 is prevented from being large.

Here, as a condition that the light from the LED does not exceed the range that the rod lens in adjacent to the rod lens that is positioned on the optical axis of the LED is positioned, as shown in FIG. 14B, defining a distance between the LED and the incident surface as D, an outer diameter of the rod lens Ren as d1, a mutual interval among the rod lenses Ren as d2, and a distance from the optical axis to an exterior edge of the rod lens Ren (1) as d, the following formulas are established, namely, $$D \cdot \tan 9° = d \tag{8}$$

$$d = 1.5d1 + d2 \tag{9}$$

Therefore, from the formulas (8) and (9), assigning tan 9°=0.1584, $$0.1584 \cdot D = 1.5 \cdot d1 + d2 \tag{10}$$

In this way, a distance D between the LED and the incident surface of the rod lens array 65, an outer diameter d1 of the rod lens Ren, and a mutual interval d2 of the rod lenses Ren are determined so as to satisfy the formula (10). Thereby, the light from the LED is configured so as not to be beyond the range that the rod lens in adjacent to the rod lens positioned on the optical axis of the LED is positioned.

Subsequently, a method for forming the condenser lens 64 in the LPH 14 according to the present exemplary embodiment will be described. In the LPH 14 according to the present exemplary embodiment, for example, by using an ink jet, the condenser lens 64 is formed. In other words, discharging a predetermined amount of an ultraviolet cured resin from a nozzle of an ink jet, this ultraviolet cured resin is directly attached oh the surface for each LED that is arranged on a SLED 63 (refer to FIG. 3) on the LED circuit board 62. In this case, the outer surface of the ultraviolet cured resin attached on the surface of the LED is formed into a lens shape due to a surface tension. Then, irradiating an ultraviolet ray from an ultraviolet ray lamp or the like on the ultraviolet cured resins on the all LED, these ultraviolet cured resins are cured. Thereby, it is possible to form the LPH 14 that is arranged with the condenser lens 64 contacting each LED.

In this case, as a material to form the condenser lens 64, an insulating material is used. Thereby, on the SLED 63 on the LED circuit board 62, generation of a leak of an electric signal is prevented.

As described above, in the LPH 14 according to the present exemplary embodiment, the condenser lens 64 is disposed between the SLED 63 and the rod lens array 65, and the condenser lens 64 is arranged in accordance with a predetermined setting condition. Thereby, the fact that the output angle of the output light from the LED that can enter the rod lens array 65 is limited by a narrow opening angle of the rod lens array 65 and the fact that the incident light amount into the rod lens array 65 is decreased in accordance with spread of the output light from the LED caused by the long working distance are prevented.

Therefore, when attaching and detaching the photosensitive module MOD to and from the main body of the image forming apparatus 1, the mechanism for separating the LPH 14 from the photosensitive module MOD is not necessarily disposed, and simplification and a low cost of the configuration of the image forming apparatus 1 are attempted. In addition, between the rod lens array 65 and the photosensitive drum 12, the cleaning member 34 for cleaning the output surface of the rod lens array 65 can be arranged, and the configuration being capable of easily removing contamination of the rod lens array 65 causing a defect of an image is realized. In addition, the configuration that a contamination is not easily attached to the rod lens array 65 is realized.

In addition, in the LPH 14 of the present exemplary embodiment in which the condenser lens 64 is arranged in accordance with a predetermined setting condition between the SLED 63 and the rod lens array 65, as the rod lens array 65, a conventional rod lens array, for example, that having an angular aperture 17° may be also used. In this case, the SLED 63 having a low light amount can be used. Further, the incident light amount to the rod lens array 65 can be increased, so that speed up of the image forming apparatus 1 can be attempted.

In addition, according to the present exemplary embodiment, the configuration that the LED is used as the light source is described, however, as the light source, a planer light emitting laser may be also used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure apparatus comprising:

a plurality of light sources;

a first condensing unit, arranged to contact a light emitting surface of each of the light sources, that condenses the lights emitted from the plurality of light sources; and a second condensing unit that condenses the lights from each of the light sources, which are emitted from the first condensing unit, wherein the first condensing unit is configured so that a center of curvature of an output surface, to emit the light from the light source, of the first condensing unit is positioned near the side of the second condensing unit rather than an arrangement position of the light source, and the first condensing unit has an object side focal point that is positioned at the opposite side of the second condensing unit with respect to the arrangement position of the light source.

2. The exposure apparatus according to claim 1, wherein the first condensing unit is configured that a light to be emitted from the output surface at an output angle not more than an angle of aperture of the second condensing unit is determined so as to have a intensity not less than ½ of the maximum intensity of the light to be emitted from the light source.

3. The exposure apparatus according to claim 1, further comprising a shielding member that shields the light to be emitted from the first condensing unit at an angle not less than the angle of aperture of the second condensing unit.

4. The exposure apparatus according to claim 1, wherein the first condensing unit comprises an insulating material.

5. The exposure apparatus according to claim 1, wherein the second condensing unit comprises a plurality of gradient index lens members arranged in an alignment, and the second condensing unit is determined that the incident light from the light source emitted from the first condensing unit into four and more gradient index lens members arranged in the alignment direction is limited.

6. An image forming apparatus comprising:

an image retaining body; and an exposing unit that exposes the image retaining body, wherein the exposing unit comprises:

a plurality of light sources;

a first condensing unit, arranged to contact a light emitting surface of each of the light sources, that condenses the lights emitted from the plurality of light sources; and a second condensing unit that condenses the lights from each of the light sources, which are emitted from the first condensing unit, wherein the first condensing unit is configured so that a center of curvature of an output surface, to emit the light from the light source, of the first condensing unit is positioned near the side of the second condensing unit rather than the arrangement position of the light source, and the first condensing unit has an object side focal point that is positioned on the opposite side of the second condensing unit with respect to the arrangement position of the light source.

7. The image forming apparatus according to claim 6, wherein the exposing unit further comprises a shielding member that shields the light to be emitted from the first condensing unit at an angle not less than an angle of aperture of the second condensing unit.

8. The image forming apparatus according to claim 6, wherein the image retaining body is configured detachably while maintaining an interval from the exposing unit with respect to an optical axial direction of the second condensing unit.

9. The image forming apparatus according to claim 6, further comprising a cleaning member that is arranged between the image retaining body and the exposing unit and cleans the output surface of the second condensing unit without changing an interval between the image retaining body and the exposing unit with respect to an optical axial direction of the second condensing unit.

10. The image forming apparatus according to claim 6, wherein the light source of the exposing unit comprises:

an input end that inputs a power from a power source;

an output end that outputs the inputted power; and a control end that inputs a control signal for outputting the inputted power from the output end; and wherein the light source is connected to a switch element that keeps an on state when the control signal is inputted in this control end and sets the light source at a state that lightning is possible.

* * * * *